United States Patent [19]

Rerolle

[11] Patent Number: 4,921,182

[45] Date of Patent: May 1, 1990

[54] MACHINE FOR WINDING CABLE

[75] Inventor: Yves Rerolle, Lyon, France

[73] Assignee: Societe Anonyme dite: Les Cables de Lyon, Clichy Cedex, France

[21] Appl. No.: 583,473

[22] Filed: Feb. 24, 1984

[30] Foreign Application Priority Data

Feb. 25, 1983 [FR] France ..... 83 03092

[51] Int. Cl.[5] ..... B65H 75/16

[52] U.S. Cl. ..... 242/54 R

[58] Field of Search ..... 242/54 R, 82, 83; 254/134.3 R, 134.5, 134.6, 382; 212/177, 182, 187, 188, 232

[56] References Cited

U.S. PATENT DOCUMENTS

| | | | |
|---|---|---|---|
| 3,244,292 | 4/1966 | Elliott | 212/188 |
| 3,247,674 | 4/1966 | Macardier | 242/54 R X |
| 3,685,668 | 8/1972 | Suverkrop | 212/256 |
| 3,719,348 | 3/1973 | Wells | 254/134.35 C |
| 3,750,970 | 8/1973 | Tremoulet, Jr. | 254/382 |
| 3,850,307 | 11/1974 | Motoda | 212/237 |
| 4,109,879 | 8/1978 | Properzi | 242/83 |

FOREIGN PATENT DOCUMENTS

| | | | |
|---|---|---|---|
| 721014 | 5/1942 | Fed. Rep. of Germany | 242/54 R |
| 1272531 | 8/1961 | France | 242/54 R |
| 88593 | 9/1965 | France . | |
| 1101387 | 10/1964 | United Kingdom | 242/54 R |

*Primary Examiner*—Harvey C. Hornsby
*Assistant Examiner*—Scott J. Haugland
*Attorney, Agent, or Firm*—Sughrue, Mion, Zinn, Macpeak & Seas

[57] ABSTRACT

A machine for winding a cable on a circular area (100), the cable (10) arriving vertically above the center of said area and being deployed by a deployment wheel (11), said area including an inner ring wall (102) and an outer ring wall (103) delimiting a winding tank therebetween, the machine comprising a stand (2) removably mounted at the center of the inner ring wall of the tank, a generally vertical pillar (3) rotatably mounted on said stand, and a hinged guide arm (4) for guiding the cable from leaving the deployment wheel to a winding end (8) of adjustable radial position thereby enabling: firstly successive coils to be laid next to one another as the cable is wound; and secondly the guide arm to be stored along the pillar when not in use. The machine is particularly intended for use when loading cable onto cable ships.

4 Claims, 3 Drawing Sheets

MACHINE FOR WINDING CABLE

The present invention relates to a machine for coiling down a cable on a circular area, the cable arriving vertically above the center of said area and being deployed by a deployment wheel, and said area including an inner ring wall and an outer ring wall delimiting a coiling-down tank therebetween, the machine including a stand mounted at the center of the inner ring wall of the tank and a substantially vertical support rotatably mounted on said stand.

BACKGROUND OF THE INVENTION

Electrical cables, and in particular underwater electrical cables, are manufactured and delivered in very long single-piece lengths. They are then stored in tanks which may be on the deck or in the hold of a cable-laying ship.

The winding machines mounted in the centers of such cable ship tanks have a major drawback in that they are permanently mounted in the center of the tank. While the cables are being, uncoiled from the tanks, the winding machines get in the way and may even damage the cable.

Preferred embodiments of the present invention remedy this drawback by proposing a transportable winding machine which need not be taken on voyage, and which thus need not get in the way of cable uncoiling operations. Another advantage of preferred transportable coiling-down machines in accordance with the invention is that they are small enough to be transported by road within the usual loading guages.

SUMMARY OF THE INVENTION

The present invention provides a machine for winding a cable on a circular area, the cable arriving vertically above the center of said area and being deployed by a deployment wheel, said area including an inner ring wall and an outer ring wall delimiting a winding tank therebetween, the machine comprising a stand removably mounted at the center of the inner ring wall of the tank, a substantially vertical pillar rotatably mounted on said stand, and a hinged guide arm for guiding the cable from leaving the deployment wheel to a winding end having an adjustable radial position thereby enabling firstly successive coils to be laid next to one another as the cable is coiled down, and secondly the guide arm to be stored along the pillar.

Advantageously, the hinged guide armis a moving portion of a deformable quadrilateral assembly and is hinged at two points: an upper point connected to a control arm; and a lower point connected to a rod.

Preferably, the hinged guide arm includes an adjustably pointed inlet funnel at its top end for ensuring the cable is inserted therein along a natural curve. The inlet funnel is adjustably pointed by two levers which are mounted at the end of the control arm and which are driven by a chain drive.

Preferably, the control arm is driven by a motor and a jack actuator (which is advantageously not reversible) for giving the desired adjustment position to the hinged arm.

BRIEF DESCRIPTION OF THE DRAWINGS

An embodiment of the invention is described by way of example with reference to the accompanying drawings, in which.

MORE DETAILED DESCRIPTION

Figure 1:
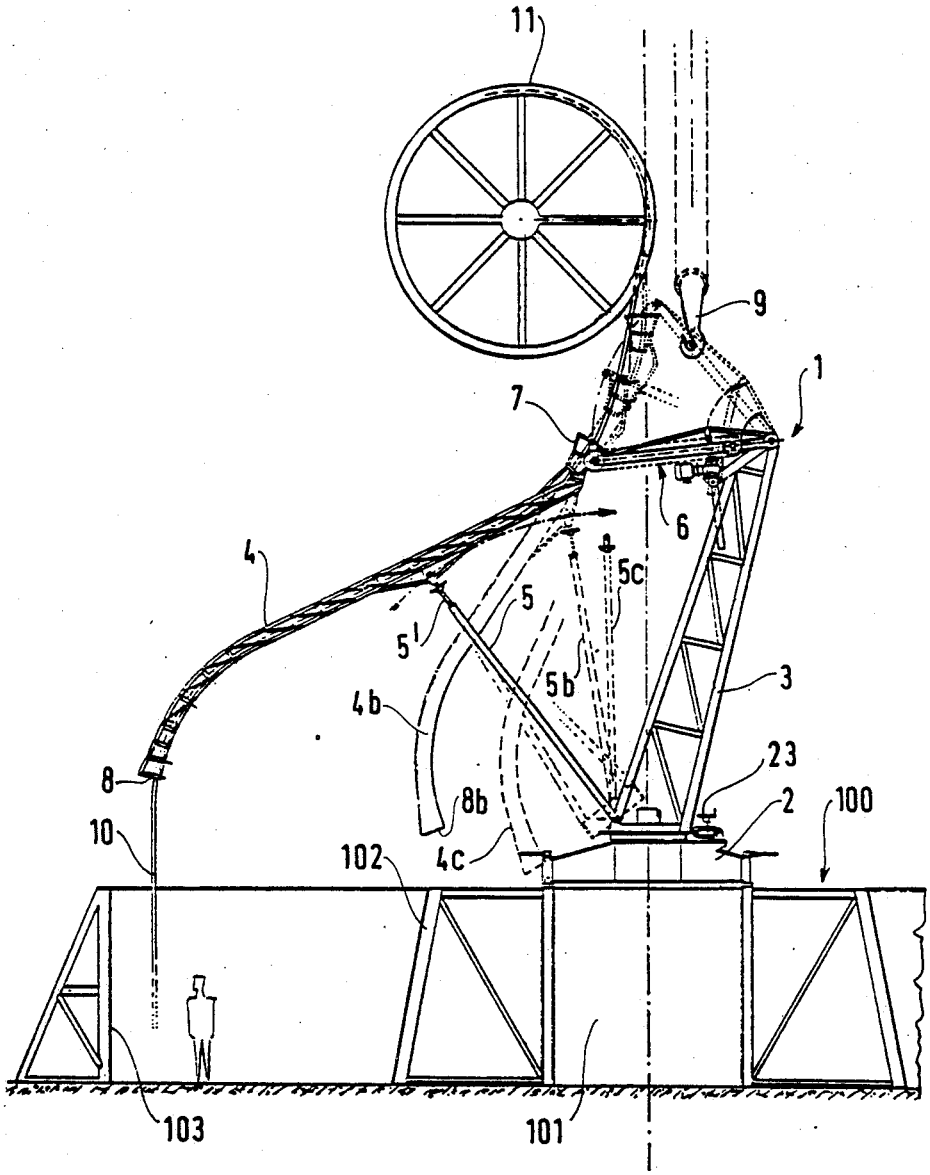
FIG. 1 is an overall view of a coiling-down machine located in the middle of a tank inside a cable ship, with its winding arm being partially shown in three different positions.

In FIG. 1 a winding machine 1 is mounted on a central structure 101 in a tank 100. An inner ring wall 102 is disposed around the central structure 101 and delimits the minimum coiling diameter for turns of a cable 10, while an outer ring wall 103 delimits a maximum coiling diameter for turns of the cable.

Figure 5:
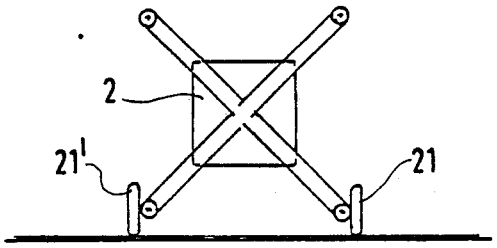
FIG. 5 is an end view of the machine as shown in FIG. 4, supported by two wheels necessary for transport purposes.

The machine 1 has a four-branch stand 2 (better seen in FIG. 5), a generally vertical pillar 3 capable of rotating on the stand 2, a hinged guide arm 4 supporting the cable 10 practically all the way from where it leaves a deployment wheel 11 which is mounted on the ship, to a laying end 8 of the hinged guide arm. The hinged guide arm 4 pivoted at a lower end to pillar 3 is held up by a rod 5 and coupled at an upper end to hinged guide arm 4 intermediate of the ends of hinged guide arm 4 whose rod length remains fixed during a winding operation, and by a control arm 6. At the end of the hinged guide arm 4 which is close to the cable deployment wheel 11 there is a cable receiving funnel or cage 7 linked to the nonlaying end of the hinged guide arm 4.

The full lines in the figure show the hinged guide arm extended to its maximum extent from pillar 3 for winding cable against the outer ring wall 103, and the dotted lines show the guide arm at its minimum extent from pillar 3 for winding cable gainst the inner ring wall 102 (position **4*b***).

Dotted lines show the hinged guide arm 4 in a transportation or storage position (position **4*c*) in which which it is even closer to central pillar 3. This position can also be seen in FIG. 4. The machine is in its transportation position c when it is initially placed into position on the central portion 101, eg. by lowering from a crane or derrick (not shown) by a hook 9 hooked to the control arm 6. The rod 5 whose length is not varied during coiling down, is shortened to positions c, eg. by means of a screw threaded end portion 5'** which can be screwed in or out by hand using a small control wheel.

Figure 2:
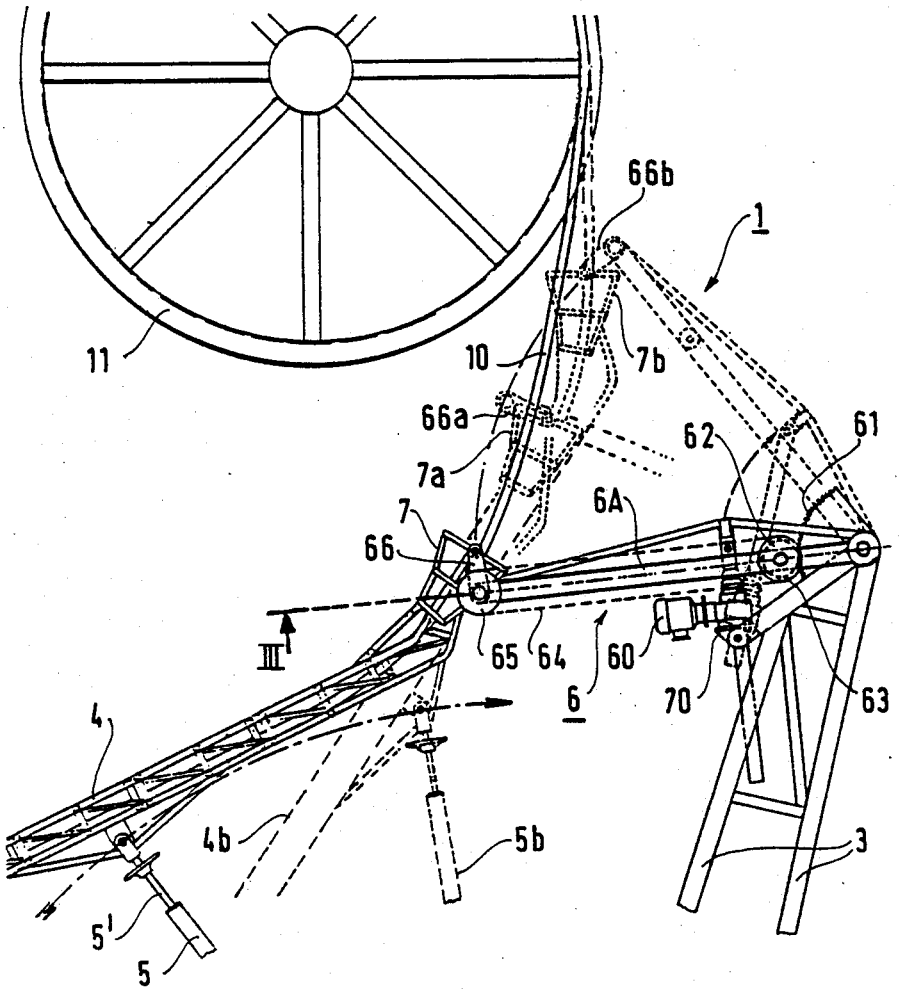
FIG. 2 is a view on an enlarged scale of a portion of FIG. 1, with a hinged guide arm funnel in the three different positions.
Figure 3:
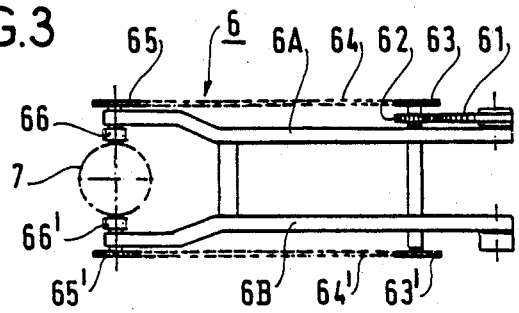
FIG. 3 is a plan view of a detail of FIG. 2 taken along line III of FIG. 2.

FIG. 2 shows in greater detail how the deployment wheel 11 brings the cable 10 to a point above the funnel 7 mounted at the top of the hinged guide arm 4. The cable passes into the funnel 7 and then into the hinged guide arm 4 itself which is fitted with guide rollers (not shown) on four inside surfaces. The funnel 7 is fixed to the hinged guide arm 4, and the resulting assembly is moved by the control arm 6. As can be seen in FIG. 3, the control arm 6 comprises two laterally spaced bars 6A and 6B, on which control arm 6, a motor 60 is mounted together with a jack actuator 70 which is preferably not reversible. The control arm 6 is caused to rotate by the action of the motor 60 on the actuator 70. As a result a toothed wheel 62 driven by motor 60 rotates about a toothed sector 61 fixedly mounted on the pillar 3.

The toothed wheel 62 is mounted on the same shaft as two chain wheels 63 and 63' which are connected by respective chains 64, 64' to two further chain wheels 65, 65'.

The two further chain wheels 65, 65' rotate two levers 66, 66' which are connected to the funnel 7 in such a manner as to ensure that it takes up a suitable cable-receiving position relative to the hinged guide arm 4 regardless of the position of the hinged arm. If the control arm 6 was directly hinged to the funnel 7, then the funnel would describe the same circular trajectory as the control arm 6, which is to be avoided since the funnel ought to describe a nearly rectilinear trajectory to ensure that the cable follows a natural curve. Three representative positions of the funnel (7, *7a, 7b*) are shown in which the levers 66 and 66' ensure that the funnel follows a much more rectilinear path than does the end of the control arm 6 which follows a circular path. At the bottom position of the control arm 6, the levers 66, 66' are nearly vertical; about half way round the arc of the control arm 6, the levers (66*a*, 66'*a*) are nearly horizontal; while at the top of the arc, the levers (66*b*, 66'*b*) slope downwardly. The tooth ratios are chosen in such a manner that when the control arm 6 moves through about 60° in the clockwise direction (as seen in FIG. 2), the levers move through about three fourths of a turn, also in the clockwise direction. The funnel 7 then follows a substantially rectilinear path.

In order to further improve the presentation of the cable 10 into the funnel 7, the control arm 6 could be adapted to change length as a function of its angular position.

The machine can be rotated to its central position in the middle of the tank under the weight of the cable, together with a little effort from the operator, if necessary. The pillar 3 rotates about a circular guide, and in the transportation position the pillar is locked against rotating by two jaws which are brought together by a handle 23, FIG. 4.

Figure 4:
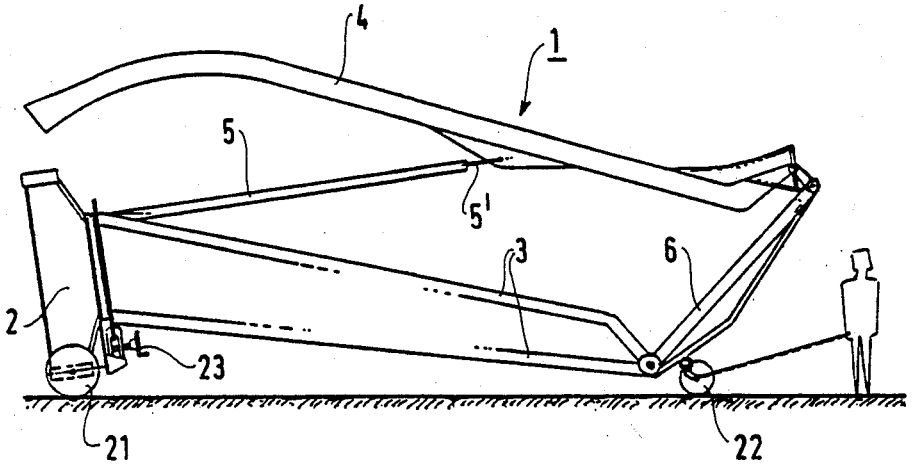
FIG. 4 is a side view of the machine when folded for transport purposes.

In FIG. 4 the machine is in its transportation position, with the hinged guide arm 4 fully folded and the rod 5 shortened, ie. with its threaded end screwed in.

A pivotable wheel 22 is mounted on the control arm 6 and two wheels 21, 21' (see FIG. 5) are mounted on the stand 2.

Without going beyond the scope of the present invention, any suitable means may be provided to motorize rotation of the machine about the center of a tank.

I claim:

1. A machine for winding a cable within a circular area which cable arrives vertically above the center of said area and is deployed by a deployment wheel, said area being defined by an inner ring wall and an outer ring wall delimiting a winding tank therebetween, said machine comprising:

a stand removably mounted at the center of the inner ring wall of the tank, a deformable quadrilateral assembly comprising a generally vertical pillar mounted on said stand for rotation about a fixed vertical axis, a control arm pivotably mounted at one end of the upper end of said pillar, a rod pivotably mounted at one end to the lower end of said pillar, a hinged guide arm having a first end and a second end, and means guiding said cable along said hinged guide arm from said first end as it leaves the deployment wheel into said guide arm to said second end where it discharges, means for pivotably mounting the other end of said rod to said hinged guide arm at a point intermediate of the ends of said hinged guide arm, and means for pivotably coupling the other end of said control arm to said first end of said hinged guide arm at a position above the connection between the control arm and said hinged guide arm;

such that said pillar, said control arm, said hinged guide arm and said rod complete said deformable quadrilateral assembly, whereby, the first end of said hinged guide arm pivotably coupled to said control arm may be maintained in a position beneath said deployment wheel for guiding the cable as it leaves the deployment wheel into said guide arm first end, while the opposite second end of said hinged guide arm may be shifted to adjustable radial positions relative to said stand to enable successive coils to be laid next to one another as the cable is wound over the complete extent of the space between said inner and outer ring walls, and said deformable quadrilateral assembly enables said hinged guide arm to be positioned alongside said pillar with said second end of said hinged guide arm in proximity thereto to facilitate transport of said machine after removal of said machine from the center of the tank.

2. A winding machine according to claim 1, wherein the hinged arm includes an angularly adjustable inlet funnel pivotably mounted at the top end of said hinged arm for ensuring that the cable is inserted therein along a natural curve during deployment of said cable within the area defined by the inner ring wall and the outer ring wall.

3. A winding machine according to claim 2, wherein two levers are mounted at the end of the control arm remove from said pillar and are coupled to said inlet funnel, and wherein a chain drive mechanism is mounted to the control arm for rotating said two levers to variably point the inlet funnel.

4. A winding machine according to claim 1, further comprising a motor mounted to said control arm and a jack actuator driven by said motor for driving said control arm about the upper end of said pillar to adjust the position of the hinged arm relative to said deployment wheel.

* * * * *